US005285668A

United States Patent [19]

Tokai

[11] Patent Number: 5,285,668

[45] Date of Patent: Feb. 15, 1994

[54] SYSTEM FOR DETECTING BENDING ANGLE FOR PRESS BRAKE

[75] Inventor: Shigeru Tokai, Ishikawa, Japan

[73] Assignee: Kabushiki Kaisha Komatsu Seisakusho, Japan

[21] Appl. No.: 917,003

[22] PCT Filed: Feb. 15, 1991

[86] PCT No.: PCT/JP91/00190

§ 371 Date: Aug. 11, 1992

§ 102(e) Date: Aug. 11, 1992

[87] PCT Pub. No.: WO91/12098

PCT Pub. Date: Aug. 22, 1991

[30] Foreign Application Priority Data

Feb. 16, 1990 [JP] Japan ..... 2-13803[U]

[51] Int. Cl.[5] ..... B21D 5/02; B21D 11/22

[52] U.S. Cl. ..... 72/10; 72/26; 72/389; 72/461

[58] Field of Search ..... 72/10, 389, 461, 26

[56] References Cited

U.S. PATENT DOCUMENTS

| | | | |
|---|---|---|---|
| 4,430,879 | 2/1984 | Rolland | 72/461 |
| 4,564,765 | 1/1986 | Blaich | 72/389 |
| 4,864,509 | 9/1989 | Somerville et al. | 72/389 |

FOREIGN PATENT DOCUMENTS

| | | | |
|---|---|---|---|
| 2044199 | 3/1972 | Fed. Rep. of Germany | 72/389 |
| 5711614 | 6/1955 | Japan . | |
| 32-50217 | 3/1957 | Japan . | |
| 0168725 | 10/1982 | Japan | 72/389 |
| 59-20924 | 2/1984 | Japan . | |
| 59-82119 | 5/1984 | Japan . | |
| 59-174221 | 10/1984 | Japan . | |
| 60-28913 | 2/1985 | Japan . | |
| 6349327 | 3/1988 | Japan . | |
| 6327855 | 7/1988 | Japan . | |
| 642722 | 1/1989 | Japan . | |
| 642723 | 1/1989 | Japan . | |
| 1-157719 | 6/1989 | Japan . | |

*Primary Examiner*—David Jones
*Attorney, Agent, or Firm*—Ronald P. Kananen

[57] ABSTRACT

It is an object to provide a bending angle detecting system for a press brake which can perform high precision bending process without employing a special die, The bending angle detecting system includes a sensor (20) provided on a back stop (8) for determining a bending position of a workpiece (7) to be subject to the bending process, and means for controlling a lower limit position of a punch (6) based on an angle signal detected by the sensor (20).

14 Claims, 6 Drawing Sheets

SYSTEM FOR DETECTING BENDING ANGLE FOR PRESS BRAKE

TECHNICAL FIELD OF THE INVENTION

The present invention relates to a bending angle detecting system for a press brake performing bending of a plate form workpiece.

BACKGROUND ART OF THE INVENTION

In a press brake for bending a plate form workpiece, it is possible to achieve high precision bending process to obtain a bending angle close to a target bending angle at one bending step by detecting a bending angle of the workpiece on bending and feeding back the detected information to a control unit for controlling a lower limit position of a ram.

Therefore, there have been proposed various methods in detecting bending angle of the workpiece during the bending process.

For example, see Japanese Unexamined Patent Publication (Kokai) No. 57-50217, Japanese Unexamined Patent Publication No. 63-49327, Japanese Unexamined Patent Publication No. 64-2722, Japanese Unexamined Patent Publication No. 64-2723 and so on.

However, in all methods, there are drawbacks in high cost for a die assembly per se due to requirement for special dies, in restriction of the size of the dies or in difficulty of detecting the angle for the workpiece having a cut-out, since the sensor for detecting the bending angle is mounted on the die or the position of the sensor is not fixed.

SUMMARY OF THE INVENTION

The present invention is to improve the drawbacks set forth above. Therefore, it is an object of the present invention to provide a bending angle detecting system for a press brake which can detect a bending angle with a sensor provided on a back stop so as to enable bending process with high precision without requiring a special die.

In order to accomplish the above-mentioned object, there is provided, according to the present invention, a bending angle detecting system for a press brake for bending process of a plate form workpiece between a die and a punch, comprising a sensor provided on a back stop which positions a bending position of the workpiece and detects a bending angle of the workpiece during bending process, and means for controlling a lower limit position of a punch based on a detected angle signal from the sensor. Therefore, it becomes possible to perform bending of the workpiece to the target bending angle with high precision.

Also, since it is unnecessary to provide the sensor on the die, the size of the die is not restricted. Also, by shifting the sensor along the back stop, it becomes possible to detect the bending angle even for the workpiece having the cut-out.

The above-mentioned and other objects, aspects, and advantages of the present invention will become clear to those skilled in the art through the discussion with illustration given herebelow and the accompanying drawings in terms of the preferred embodiment consistent with the principle of the invention.

DETAILED DESCRIPTION OF THE PREFERRED EMBODIMENT

Figure 1:
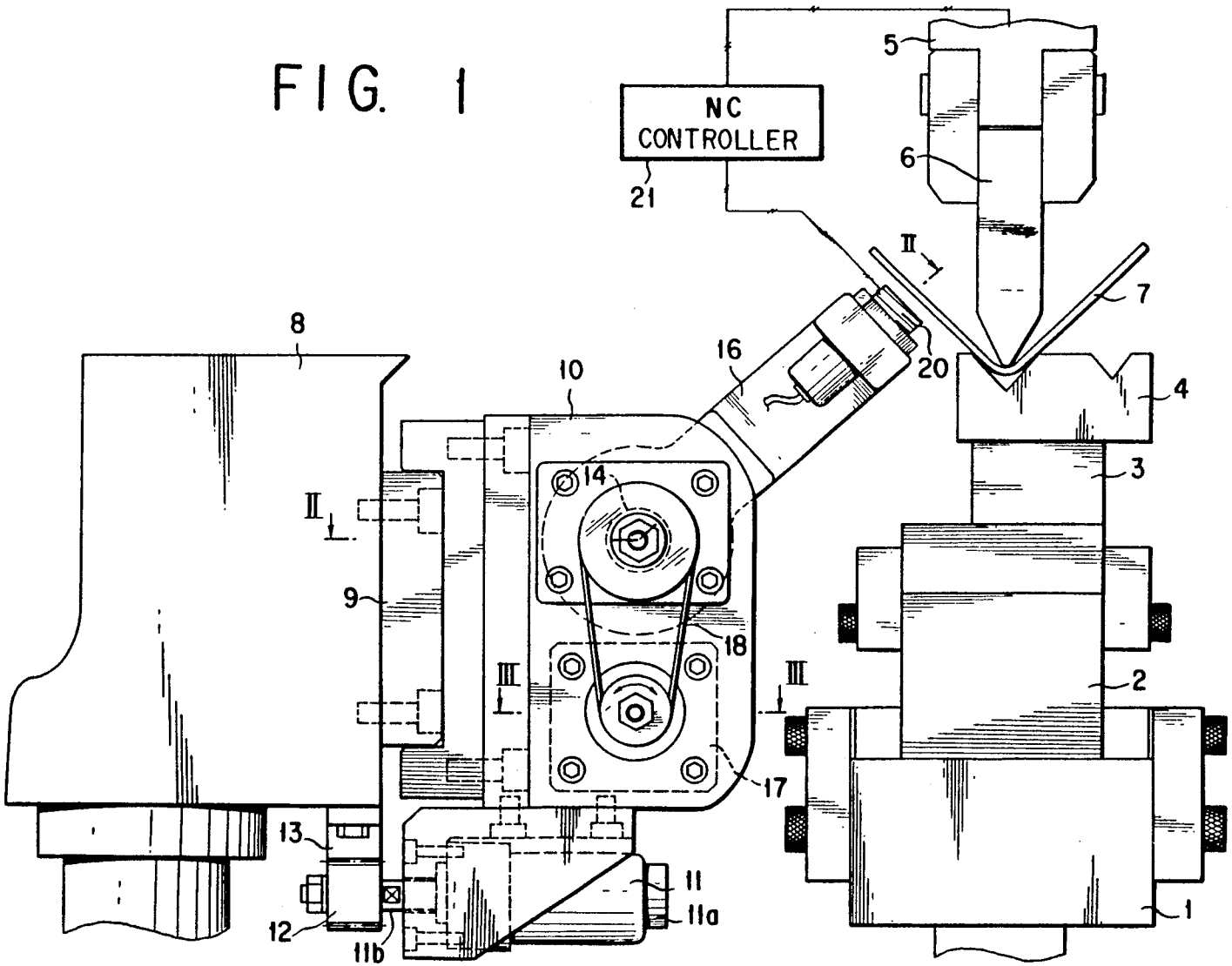
FIG. 1 is a fragmentary side elevation showing one embodiment of the present invention.

Several preferred embodiments of the present invention will be discussed hereafter in detail with reference to the accompanying drawings.

The first embodiment will be discussed in relation to FIGS. 1 through 7. In these drawings, the reference numeral 1 denotes a table of a press brake. A die base 2 is fixedly mounted on the table 1. A die 4 is mounted on the die base 2 via a die holder 3.

The reference numeral 5 denotes a ram provided above the table 1 for vertical movement. A punch 6 is mounted on the lower portion of the ram 5 so that a bending process for a plate form workpiece 7 is performed between the punch 6 and the die 4.

The reference numeral 8 denotes a back stop for determining the bending position of the workpiece 1, which back stop is adjustable of the position in vertical direction, back and forth direction and lateral direction by means of a drive mechanism (not shown). A guide rail 9 is provided on the front face of the back stop 8 and extends horizontally in the lateral direction. A slide 10 is mounted on the guide rail 9 in movable position.

A servo motor 11 for movement in the lateral direction is mounted on the lower portion of the slide 10, which servo motor is provided with an encoder 11*a*.

A pinion 12 fixed to a rotary shaft 11*b* of the servo motor 11 for lateral movement is meshed with a rack 13 provided on the lower surf ace of the back stop 8. Thus, the slide 10 is moved in the lateral direction along the guide rail 9 by the servo motor 11 for the lateral movement.

Figure 2:
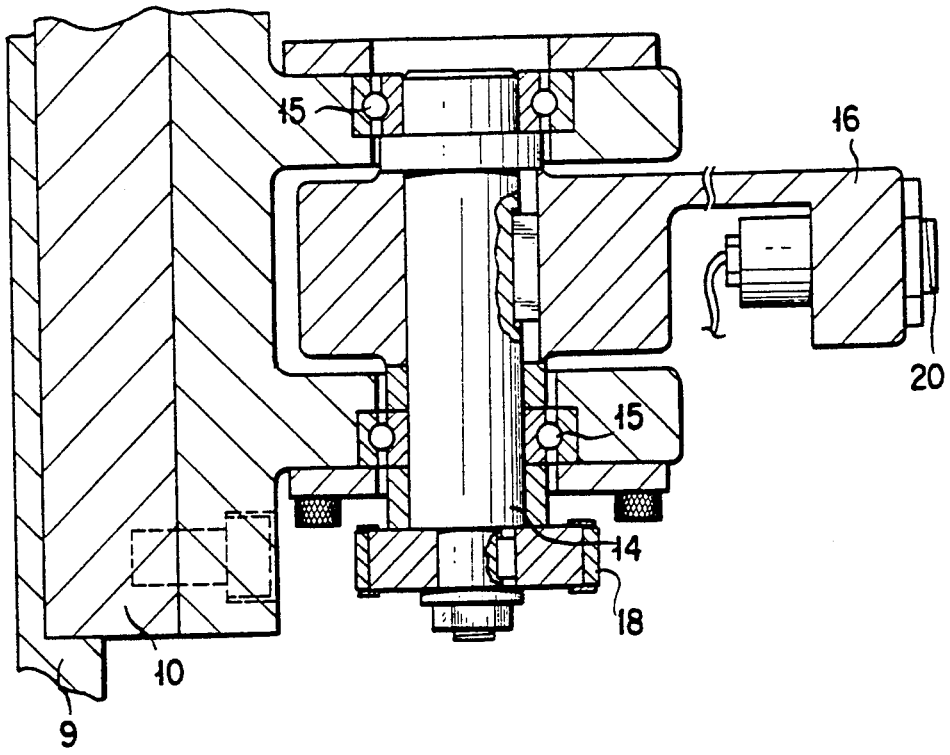
FIG. 2 is a section taken along line II—II of FIG. 1.

On the other hand, as shown in FIG. 2, a rotary shaft 14 is rotatably supported on the upper portion of the slide 10 via a bearing 15. A base end portion of a pivotal arm 16 is keyed on the rotary shaft 14.

Figure 3:
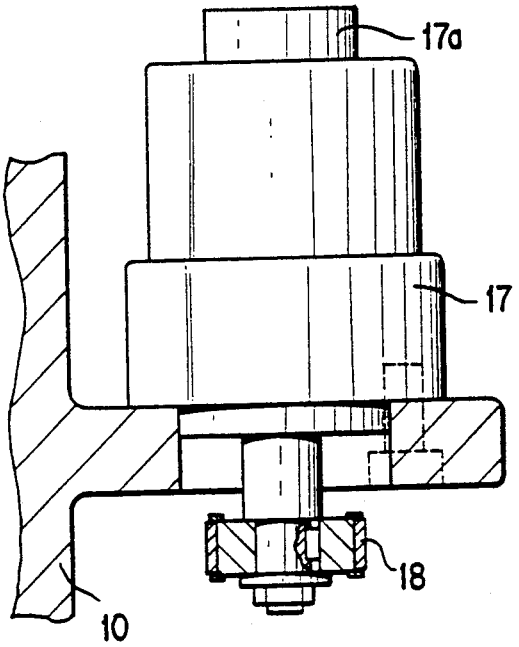
FIG. 3 is a section taken along line III—III of FIG. 1.

Furthermore, as shown in FIG. 3, one end of the rotary shaft 14 is cooperated with a servo motor 17 for pivoting the arm via an endless belt 18, which servo motor 17 has an encoder 17*a*. By pivotally driving the rotary shaft 14 by the servo motor 17, the pivotal arm 16 is pivotally driven about the rotary shaft 14.

Also, a sensor 20 is mounted on the tip end of the pivotal arm 16, which sensor is adapted to a bending angle of the workpiece non-contacting condition.

A detected bending angle signal of the sensor 20 is fed to a NC apparatus 21 for controlling a lower limit position of the ram as discussed later.

It should be noted that, as the sensor 20 for detecting the bending angle in the non-contacting position, an eddy current type displacement sensor can be employed.

Figure 4:
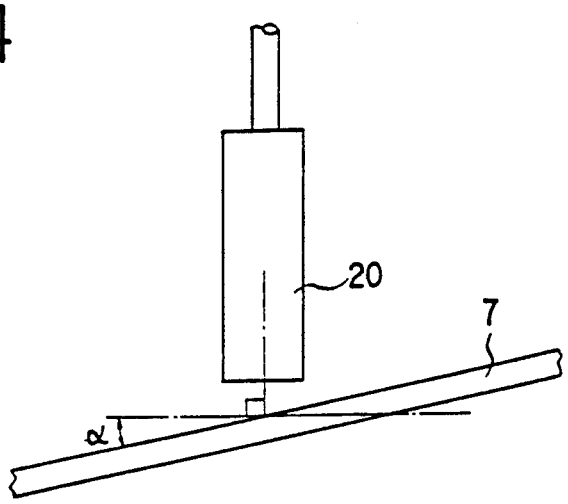
FIGS. 4 to 6 are explanatory illustration showing operation of the shown embodiment.
Figure 5:
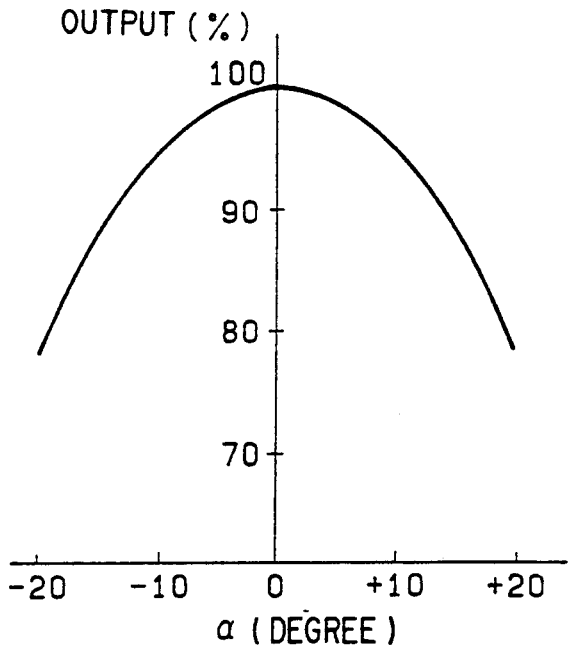

As shown in FIG. 4, the eddy current type displacement sensor 20 has characteristics to have smaller output when the workpiece is placed in an oblique angle $\alpha$ relative to that at the right angle. Therefore, it is possible to detect the tilt angle of the workpiece 7 based on the output of sensor 20.

Next, operation of the system will be discussed. Upon performing bending process of the workpiece 7, data of material, tensile strength, thickness, bending length or so forth of the workpiece 7, data of V-width, base size, V-angle, R at the tip end of the punch, tip end angle of the punch, punch height and dies height or so forth, and data of target bending angle of the product, leg length, cut-out position or so forth are input to the NC apparatus 21 through an operation panel 22.

Based on these data, the NC apparatus 21 derives the lower limit position of the ram 5, an abutting point of the back stop 8, a detecting position for detecting the bending angle or so forth.

Thereafter, an NC control is initiated to move the back stop 8 at the derived position. Then, the workpiece 7 is positioned at a bending position with abutting of the tip end to the back stop 8. When the operation of the press brake is initiated, the ram 5 is lowered with the punch 6 to start bending of the workpiece 7 between the dies 4.

When the ram 5 is stopped at the lower limit position, a lower limit signal is turned ON. The NC apparatus 21 to output a control signal to the servo motor 17 for pivotal motion of the arm. Then, the pivotal arm 16 is pivoted to a set initial angular position.

Figure 6:
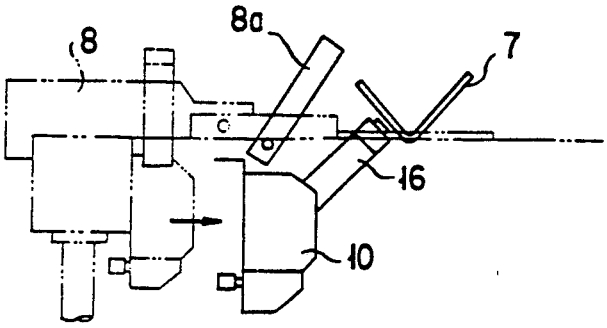

Thereafter, the back stop 8 is moved from the abutting position as illustrated by the phantom line in FIG. 6 to an angle measuring position illustrated by the solid line.

At this time, a positioning finger 8*a* extending from the back stop 8 can interfere with the workpiece 7. Therefore, by pivoting up the finger 8*a* by other action thereof, interference with the workpiece 7 is prevented.

By this action, the sensor 20 provided at the tip end of the pivotal arm 16 is placed in close proximity with the workpiece 7 which is subject to bending. At this condition, the pivotal arm 16 is swung by means of the servo motor 17 for arm pivotal motion to detect the bending angle of the workpiece 7. Once the sensor 20 detects the peak value of the bending angle, the pivotal arm 16 is returned to the set initial angular position.

On the other hand, the detecting signal of the sensor 20 is fed to the NC apparatus 21 together with a signal from the encoder 17*a* provided on the servo motor 17 for the arm pivotal movement. Then, based on an angular position of the arm, the bending angle of the workpiece 7 which is subject to bending, is derived.

The measured value obtained as set forth above is compared with a target bending angle to derive an error therebetween. When the target bending angle is smaller than the measured value, a corrected charge magnitude is calculated to further lower the ram 5 in the magnitude corresponding to the corrected charge magnitude.

Then, the detection of the bending angle is performed once again to repeat the foregoing operation until that target bending angle is greater than or equal to the measured value. When the bending angle reaches the target bending angle, the operation of the press brake is terminated. Then, the back stop 8 is moved to a moved away position.

This is for preventing the sensor 20 from being damaged by falling down of the workpiece 7 upon upward movement of the punch 6.

Thereafter, when the punch 6 is moved upwardly together with the ram 5, the bent workpiece 7 is removed from the dies 4 to complete the bending process.

Figure 7:
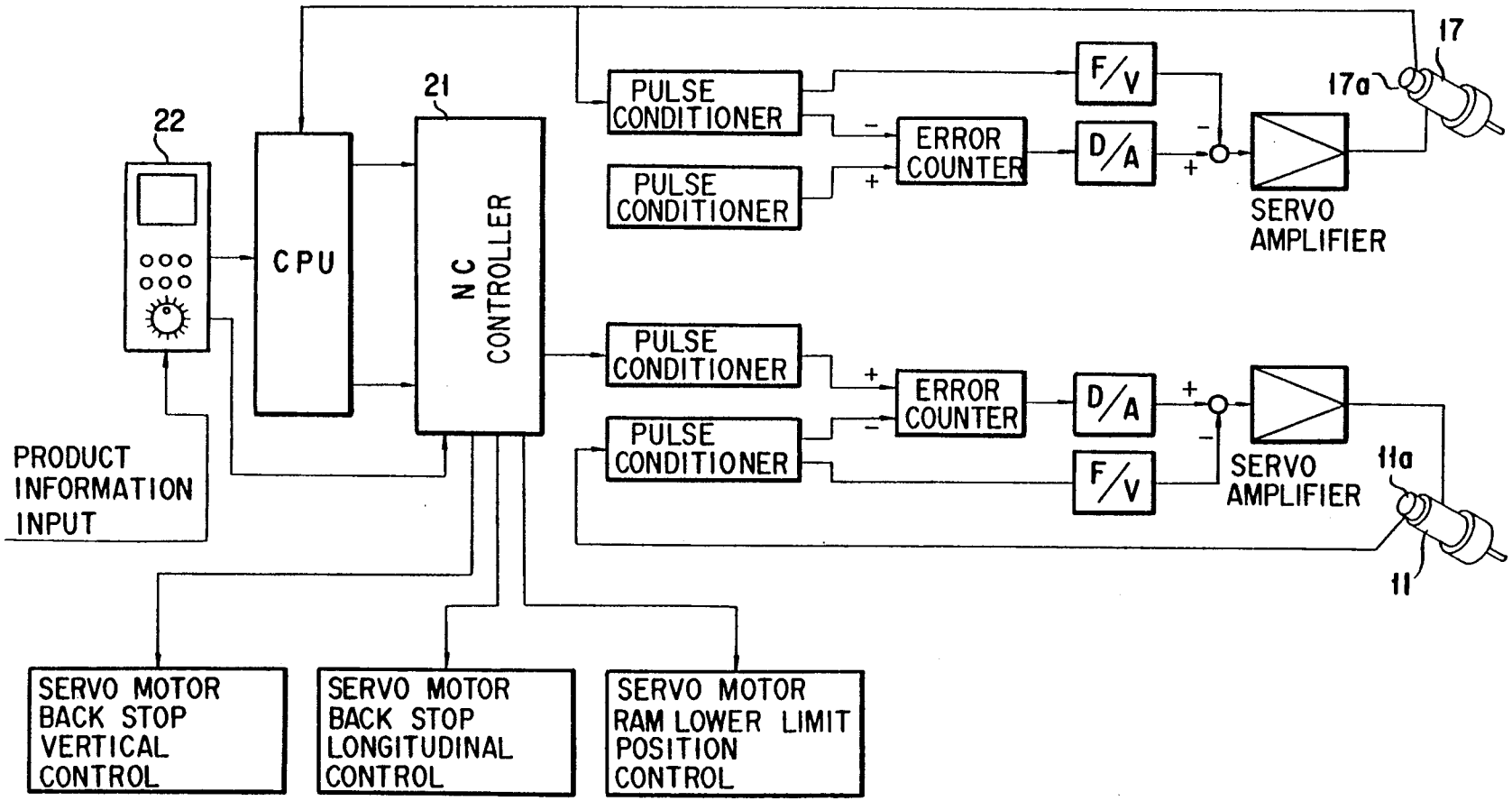
FIG. 7 is a block diagram of a control system.

FIG. 7 shows a block diagram of a drive system of the servo motor 11 for lateral movement and the servo motor 17 for the arm pivotal movement.

The circuit constructions of the drive systems are per se well known to those in the art and may not require further discussion.

Figure 8:
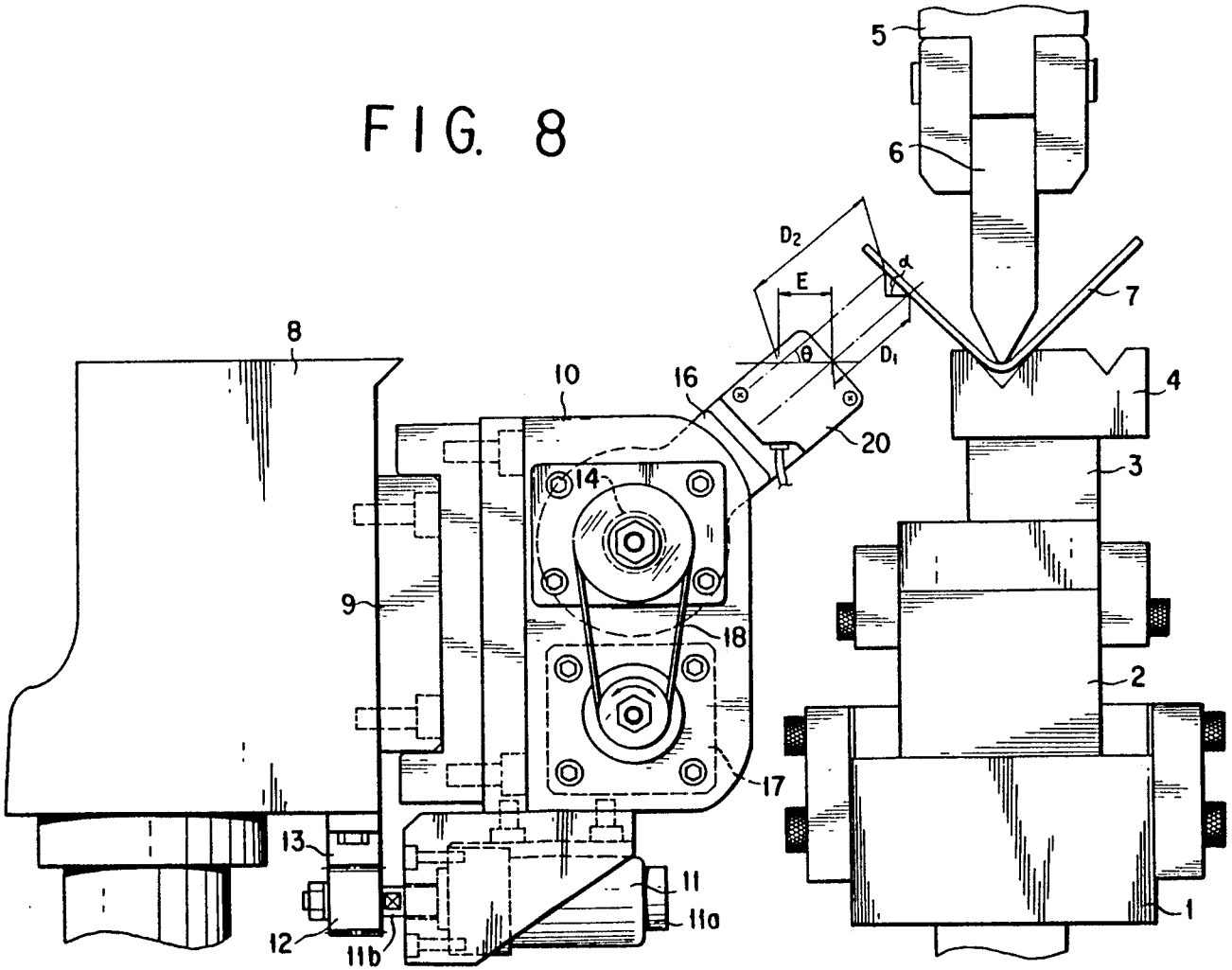
FIG. 8 is a fragmentary side elevation showing another embodiment of the present invention.

On the other hand, FIG. 8 shows another embodiment employing a laser sensor as the sensor 20. Though the basic operations are similar to the foregoing first embodiment, the detection of the bending angle is performed as discussed below.

When the sensor 20 is placed in the close proximity to the workpiece 7 shown in FIG. 8, a distance $D_1$ from the sensor 20 to the workpiece 7 is measured, initially. Then, the back stop 8 is moved rearwardly (frontwardly) in a magnitude of E to measure a distance $D_2$ from the sensor 20 to the workpiece 7.

Based on the measured values $D_1$ and $D_2$ and known values E and $\theta$, the bending angle of the workpiece 7 is calculated. Namely, $$\tan \alpha = \frac{(D_2 - D_1)\sin \theta}{(D_1 - D_2)\cos \theta + E}$$

It is similar to the foregoing embodiment in that the bending operation is repeated until the target bending angle becomes greater than or equal to the measured value.

As set forth above, since the present invention detects the bending angle of the workpiece during bending process by providing the sensor on the back stop, a special die is not required as in a conventional system employing the sensor mounted on the die. Therefore, the die per se becomes inexpensive and thus can be economically used. Also, since no space is required for the die to mount the sensor, the size of the die may not be limited.

On the other hand, it becomes possible to detect the bending angle by shifting the sensor along the back stop even when the work has a cut out. Furthermore, it is possible to automatically obtain the correction data (lateral inclination, internal angle correction magnitude, charge magnitude) for charge bending process by providing sensors on a plurality of positions on the back stop. Therefore, by inputting these data to the NC apparatus, it becomes possible to easily and accurately perform automatic correction during bending process.

What is claimed is:

1. A bending angle detecting system for a press brake for a bending process of a workpiece between a die and a punch, comprising:

a back stop located on the press brake for determining a bending position of said workpiece;

a sensor means provided on said back stop in the vicinity of said workpiece being bent for directly detecting a bending angle of the workpiece during said bending process;

means for driving said punch for performing said bending process; and means for controlling a lower limit position of said punch based on a detected angle signal from the sensor means.

2. A bending angle detecting system as set forth in claim 1, wherein said sensor means is movably supported on said back stop.

3. A bending angle detecting system for a numerically controlled press brake for a bending process of a workpiece between a die and a punch, comprising:

a back stop located on the press brake for determining a bending position of said workpiece;

a sensor means provided on said back stop in the vicinity of said workpiece being bent for directly detecting a bending angle of the workpiece during said bending process positioning of said back stop and sensor means being automatically adjusted based on preliminarily input numeric data;

means for driving said punch for performing said bending process; and means for controlling a lower limit position of said punch based on a detected angle signal from the sensor means.

4. A bending angle detecting system for a press brake for a bending process of a workpiece between a die and a punch, comprising:

a back stop located on the press brake;

a sensor means provided on said back stop in the vicinity of said workpiece being bent for directly detecting a bending angle of the workpiece during said bending process, said sensor means being movably supported on said back stop;

means for driving said punch for performing said bending process; and means for controlling a lower limit position of said punch based on a detected angle signal from the sensor means.

5. A bending angle detecting system as set forth in claim 4, wherein a first adjustment means is provided for moving said sensor means in a lateral direction with respect to said back stop.

6. A bending angle detecting system as set forth in claim 5, wherein a second adjustment means is provided for pivotally moving said sensor means with respect to said back stop.

7. A bending angle detecting system as set forth in claim 6, wherein sensor adjustment drive means are provided for driving said first and second adjustment means.

8. A bending angle detecting system as set forth in claim 7, wherein said sensor adjustment drive means includes a rack and pinion assembly for driving said first adjustment means and a pivotally driven shaft for driving said second adjustment means.

9. A bending angle detecting system as set forth in claim 7, further comprising a control unit for controlling said sensor adjustment drive means automatically based on preliminarily input data.

10. A bending angle detecting system for a pres brake for a bending process of a workpiece between a die and punch, comprising:

a back stop located on the press brake;

a sensor means disposed adjacent to said workpiece for directly detecting a bending angle thereof during said bending process, said sensor means outputting an angle signal representative of said detected bending angle;

mean for mounting said sensor means on said back stop for movement relative thereto in a lateral direction and in a pivotal direction; and means responsive to said angle signal for controlling a lower limit position of said punch which is movable relative to said die during said bending process.

11. A bending angle detecting system as set forth in claim 10, wherein sensor adjustment drive means are provided for moving said sensor means in said lateral and pivotal directions.

12. A bending angle detecting system as set forth in claim 11, wherein said sensor adjustment drive means includes a rack and pinion assembly for moving said sensor means in said lateral direction and a pivotally driven shaft for moving said sensor means in said pivotal direction.

13. A bending angle detecting system as set forth in claim 11, further comprising a control unit for controlling said sensor adjustment drive means automatically based on preliminarily input data.

14. A bending angle detecting system for a press brake for a bending process of a workpiece between a die and punch, comprising:

a sensor means disposed adjacent to said workpiece for detecting a bending angle thereof during said bending process, said sensor outputting an angle signal representative of said detected bending angle;

a back stop located on the press;

means for pivotally mounting said sensor means on said back stop for pivotal movement relative thereto;

means for driving said sensor mounting means for displacing said sensor means relative to said back stop for placing said sensor means at a detecting position; and means responsive to said angle signal for controlling a lower limit position of said punch which is movable relative to said die during said bending process.

* * * * *